United States Patent [19]

Dukess

[11] 3,963,845

[45] June 15, 1976

[54] HIGH FREQUENCY HEAT SEALING CONTAINER CLOSURE

[76] Inventor: Joseph Dukess, 931 Greacen Point, Mamaroneck, N.Y. 10543

[22] Filed: Sept. 3, 1974

[21] Appl. No.: 502,424

Related U.S. Application Data

[63] Continuation-in-part of Ser. No. 222,614, Feb. 1, 1972, abandoned.

[52] U.S. Cl. ..... 428/64; 215/347; 264/25; 264/26; 264/45.9; 428/323

[51] Int. Cl.[2] ..... B32B 31/20; B65D 53/04

[58] Field of Search ..... 156/262; 161/42, 159; 215/DIG. 4, 329, 347, 350; 220/DIG. 19; 264/268, 25, 26, 45.9; 425/809; 428/213, 64, 309, 323, 516

[56] References Cited

UNITED STATES PATENTS

| | | | |
|---|---|---|---|
| 1,431,871 | 10/1922 | Burnet | 161/42 X |
| 2,238,681 | 4/1941 | Dorough | 161/42 X |
| 3,143,364 | 8/1964 | Klein | 156/294 X |
| 3,420,923 | 1/1969 | Ashworth et al. | 264/26 |
| 3,620,875 | 11/1971 | Guglielmo, Sr. et al. | 156/272 |
| 3,706,176 | 12/1972 | Leatherman | 156/272 X |

*Primary Examiner*—William J. Van Balen
*Assistant Examiner*—Henry F. Epstein
*Attorney, Agent, or Firm*—Kenneth S. Goldfarb

[57] ABSTRACT

A container closure liner in the form of a layer arrangement having a compressible intermediate layer having high frequency heat sealing characteristics disposed adjacent the lip of a container for bonding thereto. Another layer may be squeezed beyond the periphery of the material for making a better seal.

1 Claim, 7 Drawing Figures

FIG. 1
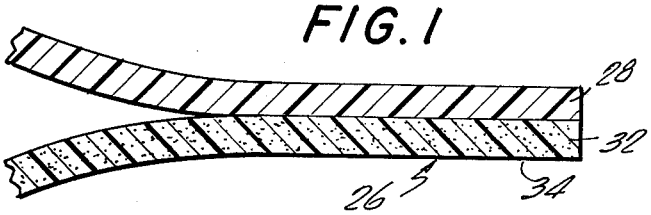
FIG. 2
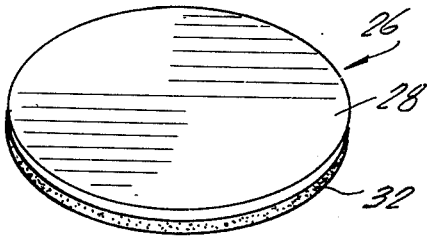
FIG. 3
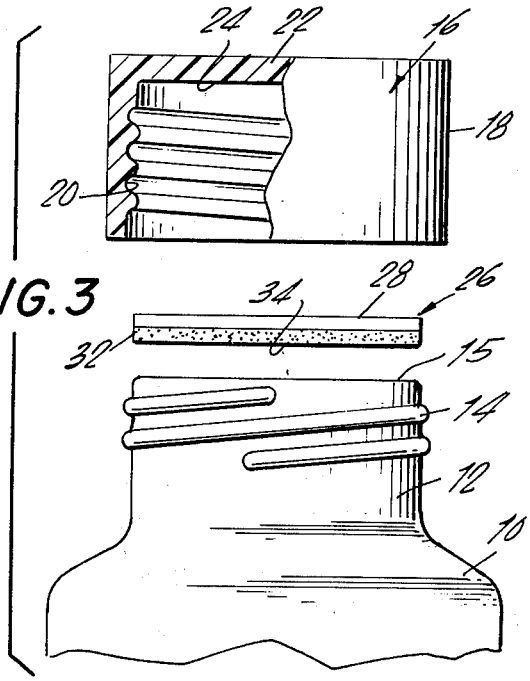
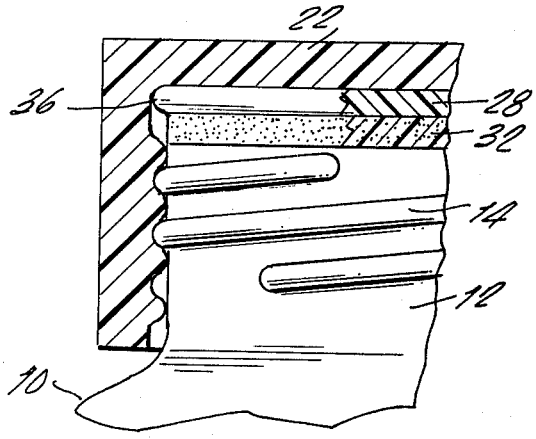
FIG. 4
FIG. 5
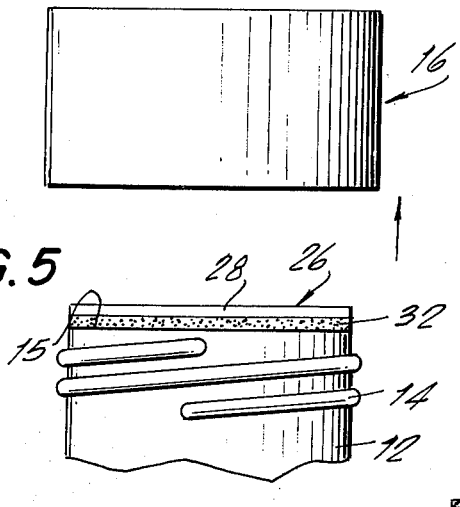
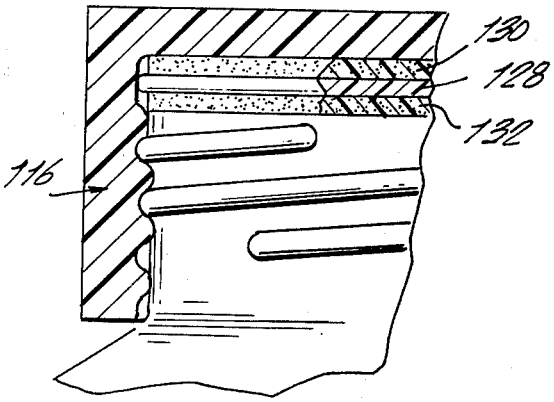
FIG. 7
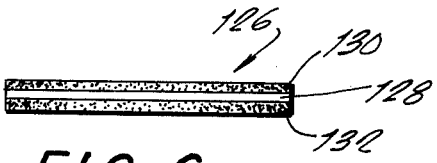
FIG. 6

HIGH FREQUENCY HEAT SEALING CONTAINER CLOSURE

This invention relates to material for cap liners and is a continuation-in-part of application Ser. No. 222,614, filed Feb. 1, 1972 and now abandoned for "High Frequency Heat Sealing Container Closure."

Various types of cap constructions utilizing liners have been devised in the past. These liners are employed to seal the contents of the container preventing leaking between the threaded portions of a container neck and the cap by providing for a positive seal at the mouth of the container. Such previous cap constructions and liners and material used for liners therefor have been a compromise between the requirement that the liner material be stress and crack resistant while also being moisture impervious and impervious to chemicals and acids, yet being bendable and compressible enough to provide for an effective seal. The present invention overcomes the difficulties of the prior art liner material and has all of the advantages of these prior materials without the corresponding disadvantages.

A further advantage of the liner according to the present invention is that liners are capable of being stamped out of stock liner material without freezing.

Another feature of the present invention is that the layer of material adjacent the lip of the container is formed of a suitable material such as metallized thermoplastic, such as polyethylene, polypropylene, polyvinyl chloride, or the like, so as to be enabled to be heat sealed to the lip of the container by high frequency means.

A further feature of the invention resides in providing liner material capable of forming a liner that is freely rotatable within the cap until such time as the mouth of the container is firmly against the liner compressing the liner so that an intermediate layer of the liner is compressed and expands outwardly thereby abutting against the side walls of the cap for making a most effective seal.

A further object of the invention resides in the provision of a liner material that is capable of being extruded as a multilayer arrangement.

Still further objects and features of this invention reside in the provision of a high frequency heat sealable liner that is capable of being extruded by conventional machinery and which can be conveniently stamped to shape without requiring freezing, thereby permitting manufacture at a relatively low cost and which is highly effective in use.

These, together with the various ancillary objects and features of the present invention, which will become apparent as the following description proceeds, are attained by this high frequency heat sealing container closure, preferred embodiments of which are illustrated in the accompanying drawing, by way of example only, wherein:

FIG. 1 is a vertical sectional view of one form of liner as it is being extruded:

FIG. 2 is a perspective view of a liner according to the present invention;

FIG. 3 is an exploded sectional detail view illustrating the cap and liner therefor made from liner material according to the invention;

FIG. 4 is an enlarged vertical detail view illustrating a portion of the cap and liner therefor as firmly secured on a container;

FIG. 5 is a sectional detail view showing the cap and liner therefor in a stage of being secured on the neck of a container;

FIG. 6 is a vertical sectional view of another embodiment of liner material;

FIG. 7 is a view similar to FIG. 4, showing the shape of the embodiment of FIG. 6 after the liner has been compressed when the cap has been tightly closed on the container.

With continuing reference to the accompanying drawing, wherein like reference numerals designate similar parts throughout the various views, reference numerals 10 is used to generally designate a conventional plastic or glass container, such as a bottle, tube, or can having a neck 12 which is threaded at 14. In order to provide a closure for the container 10, a cap 16 is employed which includes cylindrical side walls 18, which are internally threaded at 20, and a top 22. The cap may be a snap cap, crown, or the like in lieu of being threaded. A cylindrical groove 24 is formed as the uppermost of threads 20 and is for the purpose of receiving therein a liner 26. The cap 16 is preferably molded out of any suitable synthetic plastic material and is adapted to be threadedly secured on the neck 12 with the threads 20 engaging the threads 14.

The liner 26 is from a liner material in accordance with the invention formed of a combination of an upper layer 28 and a lower layer 32, the line 26 preferably being stamped in the shape of a disc. The upper layer 28 is formed of a thermoplastic rubber-like foam material. Materials which can be used also include polyisobutylene in polyethylene, known as Pliothene, or other resilient material, such as ethylene vinyl acetate copolymer, or the material sold under the trademark Kraton, which is a thermoplastic rubber or polyvinyl chloride or the like. Particularly, this material is resilient though not necessarily as resistant to stress and cracks or as impervious to foreign substances as the material of the lower layer 32. The lower layer is a metallized thermoplastic, such as polyethylene, polypropylene, polyvinyl chloride, or the like, having finely divided iron, copper, or steel powder embedded therein. When the layer arrangement is manufactured by way of simultaneous multiple extrusion, the upper layer 28 and lower layer 32 are extruded simultaneously, and the various layers are brought together within a combination die and at about 300°F. for bonding within the combination die, as shown schematically in FIG. 1. The resultant sheet material has a much increased resistance to distortion or stress can be stamped without freezing and is impervious to chemicals and acids as well as moisture.

When the disc 26 is inserted in the groove 24 in a normal state, it will freely rotate therein permitting for effective setting of the disc 26 within the groove 24 and effective engagement of the mouth 15 of the container 10 against the under surface 34 of the layer 32. Continued closure of the cap 16 will cause the resilient upper layer 28 to be compressed exuding a tongue 36 beyond the peripheral edges of the lower layer 32 and as shown in FIG. 4 against the inner wall of the groove 24 frictionally sealing the liner 26 with the cap 16.

As shown in FIG. 5, the liner 26, when placed on the mouth 15, can be effectively bonded to the container 12 through high frequency heat sealing. The mouth 15 is flat and the disc of the liner 26 seats flush thereon. With the cap thereon and with resilient pressure on the layer 32, the assembly can be passed through a zone of high frequency radiations and due to the presence of the metal particles in layer 32, the layer 32 will bond to the mouth 15. Thus, there is achieved an inner effective seal and closure for the contents of the container 10 than heretofore possible to achieve while retaining all of the desirable features of the less resilient low density thermoplastic which is used for the outer layers. Further, after breaking the bonded seal, the liner 26 can be reversed.

In FIGS. 6 and 7 there is shown a modified form of the invention wherein a three-ply liner 126 is used, there being an intermediate liner 128 of a thermoplastic rubber-like foam and outer liners 130–132, which are metallized in the manner of lower layer 32. The intermediate layer will form a tongue 136 when the cap 116 is screwed tight. In this form of the invention, the liner 126 can be reversed and resealed using high frequency radiations.

It is within the concepts of this invention to make a liner with three, four, five, or more layers of material. Further, the washer of FIG. 2 and FIG. 3 can be reversed and the layer 32 bonded by high frequency heating to the cap 16 as may be desired.

The disc may have an opening or openings therein should the disc be desired for use as an orifice reducer.

A latitude of modification, substitution and change is intended in the foregoing disclosure, and in some instances, some features of the invention will be employed without a corresponding use of other features.

I claim:

1. Liner material adapted to be removably mounted in a cap comprising a disc including a pair of outer layers and an intermediate layer sandwiched between said outer layers and bonded thereto, said outer layers being of a relatively nonresilient thermoplastic resinous material and containing metal powder selected from the group consisting of iron, copper and steel therein, said outer layers, due to the presence of said metal powder, being capable of being bonded to the mouth of a plastic or glass container when exposed to high frequency radiation to provide an effective bond seal and closure for the contents of the container, said intermediate layer being of a resilient, compressible foam thermoplastic rubber-like material capable when compressed of exuding a tongue beyond the peripheral edges of said outer layers to frictionally seal said liner with said cap, said liner, when uncompressed, being freely rotatable within said cap after breaking said bonded seal.

* * * * *